United States Patent [19]

Goretti

[11] 4,171,194

[45] Oct. 16, 1979

[54] PLANT FOR THE PRODUCTION OF CONCRETE ELEMENTS

[75] Inventor: Cesare Goretti, Rome, Italy

[73] Assignee: Italiana Prefabbricazione Edile S.p.A., Rome, Italy

[21] Appl. No.: 877,734

[22] Filed: Feb. 14, 1978

[30] Foreign Application Priority Data

Mar. 25, 1977 [IT] Italy ..... 48656 A/77

[51] Int. Cl.[2] ..... B28B 15/00

[52] U.S. Cl. ..... 425/88; 425/213; 425/DIG. 200

[58] Field of Search ..... 425/88, DIG. 200–201, 425/213; 249/158

[56] References Cited

U.S. PATENT DOCUMENTS

| | | | |
|---|---|---|---|
| 3,732,052 | 5/1973 | Gunia | 425/88 |
| 3,739,050 | 6/1973 | Koncz et al. | 425/88 |
| 3,825,394 | 7/1974 | Pietrowiak | 425/88 |
| 3,931,951 | 11/1976 | Fougea | 249/158 |
| 4,105,382 | 8/1978 | Auer et al. | 425/88 |

*Primary Examiner*—John McQuade

*Attorney, Agent, or Firm*—Cushman, Darby & Cushman

[57] ABSTRACT

The present invention refers to a plant for the mass production of prefabricated structural elements for the building industry, such as prestressed or unprestressed concrete wall panels.

10 Claims, 7 Drawing Figures

PLANT FOR THE PRODUCTION OF CONCRETE ELEMENTS

The increasing utilization of prefabricated structural elements in the building industry, due to the considerable savings in time, labor and material costs it permits, has led to the development of new prefabrication methods. However, the plants for carrying these methods into practice required either highly skilled operators or, if based on the employment of unskilled personnel, a very complex equipment, whose maintenance and repair again required specialized technicians. The common principle of these known plants is to use stationary machinery for handling the molds into which the concrete is cast and for successively treating the resulting castings, while both the molds and the resulting castings pass under said machinery on a moving track, which is either straight or circular.

The object of the present invention is a plant which can be erected in approximately one third of the time required to erect a conventional plant of a comparable production capacity. It has the additional advantage of requiring only a small fraction of the covered area needed by comparable conventional plants to protect the operators from sunshine and rain and the concrete casting from these weather agents until they have been cured and have hardened. Its further great advantages are its low installation costs and time and that it can be operated by workers which can be quickly trained to perform the few single operations required for each manufacturing stage. This is of extreme importance since the plants of this type are mainly intended for countries where skilled labor is not available. The present invention permits to attain these and other objects and advantages by using a stationary track to support the molds and the castings, while the machinery for the treatment moves on a train of cars which straddle said track. Each car is covered, so that not only the operators, but also the castings are sheltered against sunshine and rain throughout their whole treatment cycle, till after their curing stage, whereafter the concrete requires no further protection. Therefore the whole covered area needed is that which covers the cars and the whole work of installing.

Such a plant consists essentially of placing the track, installing a pair of rails for the trolley on each side of said track and placing the required machinery on said cars.

The present invention will be better understood from the following description of one of its examples of embodiment, made with reference to the attached drawings, wherein.

Figure 1:
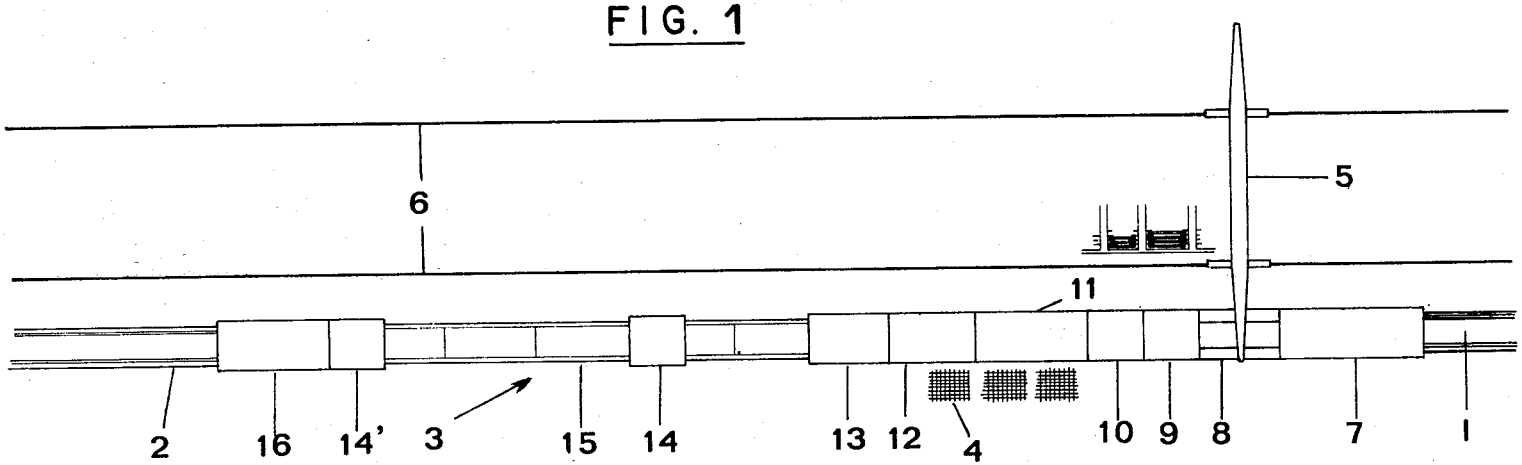
FIG. 1 is a schematic top view of the embodiment.
Figure 2:
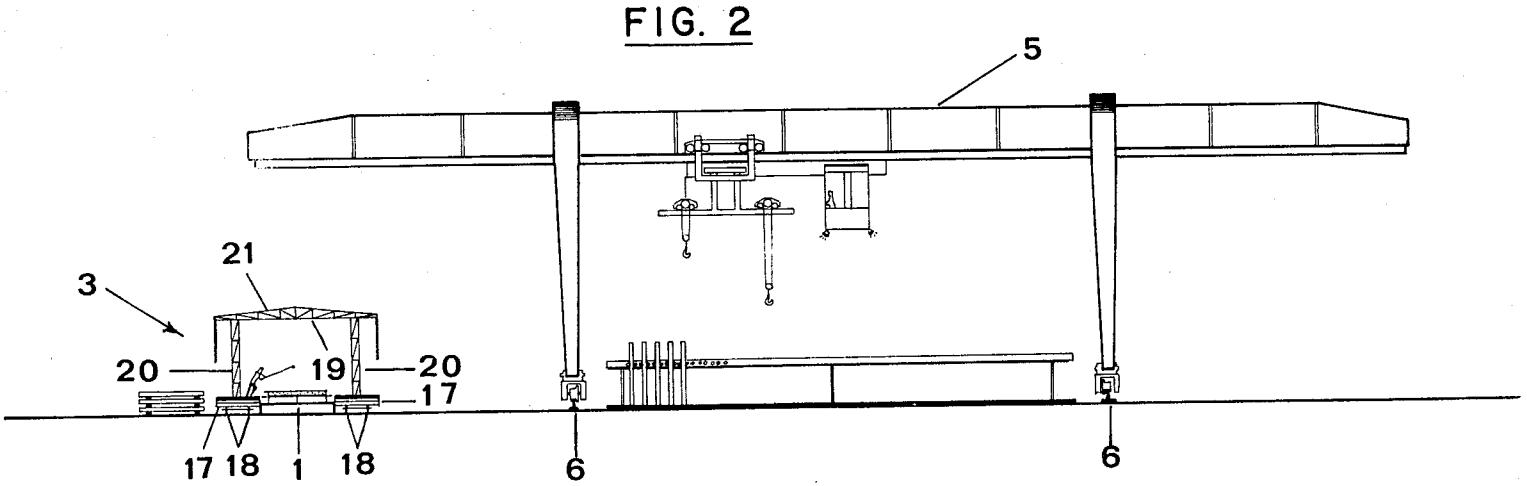
FIG. 2 is an elevational lateral view from one end of a plant according to FIG. 1.

With reference to FIGS. 1 and 2, there is indicated at 1 a rectilinear raised track formed of a concrete block topped by a single long metal plate or by an uninterrupted succession of shorter metal plates which are placed end to end and extend over the whole concrete block and are made rigid with it. This plate or plates will form the bottom of the molds used for casting the building elements.

The longitudinal side panels or walls of the molds are formed by panels connected to each side of the mold bottom by a number of connecting rods, whose one end is hinged to the borders of said bottom plate and their other end to said panels. In this way, each longitudinal wall forms one side of a link parallelogram and therefore it is only capable of a translational movement, in which it always remains parallel to its initial position and therefore parallel to its opposite longitudinal wall. Similarly, at given intervals, pairs of transverse panels are provided and also connected two by two to the bottom plate or plates by link rods to form two opposite sides of a link parallelogram, lying, in every position they assume, at a right angle with the longitudinal walls, so that one of each pair of the transverse walls forms one side wall of one mold, the other a side wall of the adjacent mold. In this way, whatever its length or width, the mold will always form an exact rectangle. However, the above described type of mold is per se known and needs therefore no additional description, except that once its walls have been moved into the required position, they are fastened to the bottom by means of bolts or pins passed through holes provided in said side walls and in said bottom.

Any shape whatever can be given to said longitudinal and transversal side walls, according to the shape which has to be imparted to the castings. Said side walls may be also provided with suitable devices for containing hooks and metal reinforcements projecting beyond the castings.

If the bottom plate is made of a single element, it will have along its borders continuous metal guides for the application of vibrators, sliding on the mold walls. In case that said bottom is formed of a series of single plates the vibration may be obtained either by wall vibrators placed beyond each plate or by means of a vibrator station placed on an extra car.

Two pairs of rails 2 run at each side of the track 1 to guide the train of cars, which train is here generally indicated at 3. Each car of this train is formed by two trolleys, one at each side of the track, and they are rigidly interconnected. Each car carries the machinery provided for the sequential treatment of the castings. The platforms of the trolleys are level with the mold bottom and the gap between each trolley and the adjacent track edge is kept at a minimum in order to eliminate any dangers of casualties to the personnel and to prevent tools from falling or becoming wedged between the trolley platform and the track edge.

Rails 2 extend beyond the two ends of track 1 for a length required for containing the whole train.

Externally to the rails 2, there are placed, at one side, the preformed concrete reinforcement cages 4, each lying correspondingly to the mold into which it has to be placed. Advantageously the preformed cages 4 are arranged in a series of piles so as to be ready to be used in a succession of production cycles.

On the side opposite to where the cages 4 are piled up, a runway, consisting of a pair of rails 6, is provided, on which rolls a transport means, such as a bridge crane 5, to carry inserts to be placed within the mold in order to form doors, windows, grooves for electric conduits or water and gas piping in the structural building elements which are being fabricated in the molds.

The bridge crane 5 shown in FIG. 2 also serves for removing the finished castings and load them into other transport means or discharge them directly into a place of storage.

Obviously, in lieu of said bridge crane other material handling and/or moving devices can be equally well adopted.

The train 3 moves stepwise from one mold to the next one, and at each step the equipment mounted on each car works on the mold it has reached during this motion. The time of stay of the train 3 between each step forms the production rythm and is predetermined as a function of the predominant operating stage. The length of each car or the number of adjacent cars equipped in the same manner for carrying out the same operating step will be therefore determined as a function of the ratio between the time of performance of said step and the time of stay which has been prefixed for each step.

A train 3 forming the illustrated embodiment of the invention, and particularly adapted for the manufacture of precast wall panels, comprises in succession: a car 7 carrying an equipment for withdrawing the longitudinal and transversal side walls of the molds; a car 8 carrying an equipment for tilting up the cured concrete panels and for removing them successively; a car 9 equipped for cleaning the molds and for applying to them a mold release agent, for facilitating the removal of the castings from the molds; a car 10 equipped for placing the cages of reinforcing steel; a car 11 equipped for shifting the mold walls into their desired position; a car 12 equipped for placing into the molds the desired inserts and accessories; a car 13 equipped for casting the concrete into the mold; a first and a second car 14 and 14' respectively equipped for vibrofinishing the castings, between which cars and the preceding car 13 are placed small roofs 15 formed by telescopic segments capable of protecting the surface of the castings from rain or eccessively strong sun rays; a car 16 equipped for placing upon the finished panels hoods for their successive steam treatment.

Each car consists, as already stated, of two trolleys 17, each on one side of the track 1, and equipped with wheels 18 which roll on rails 2. From each end of each trolley rises a lattice post 20, the top of each post of each trolley being connected to the top of the corresponding post of the other trolley by a truss 19. In this manner, the two trolleys of each car are rigidly interconnected, and are covered by a roof 21 placed on said trusses 19.

Figure 3:
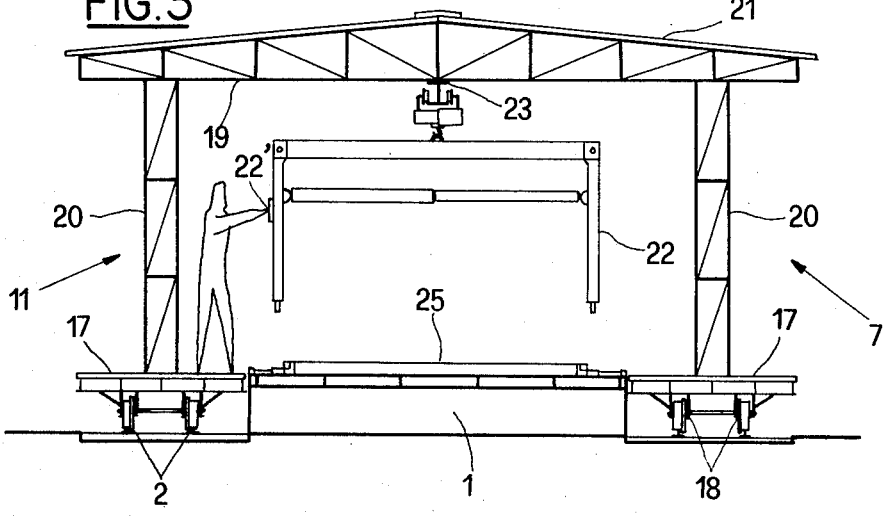
FIG. 3 is an elevational lateral view of a car equipped for adjusting the size of molds.

Some examples of the equipment placed on the cars are shown in the figures. FIG. 3 refers to the head car 7, equipped for the removal of the longitudinal and transversal mold walls from the concrete panel after the panel has hardened, and refers also to car 11 intended for the reverse operation of shifting all four mold walls into position.

Cars 7 and 11 are fitted with (not shown) power tools for screwing or unscrewing the bolts which fasten the mold walls in the required position as well as with devices, such as that indicated at 22, which have two legs, which can be inserted into the bolt holes of opposite mold walls. Be acting on the hand wheel 22', the distance between said legs and consequently between said opposite mold walls can be adjusted to requirement. This device is hung on rail 23, fastened to the underside of the trusses 19 and therefore can be moved relatively to the train of cars and independently of it. This arrangement permits a certain flexibility of the mold wall handling operations relatively to the rhythm of the other operations.

Figure 4:
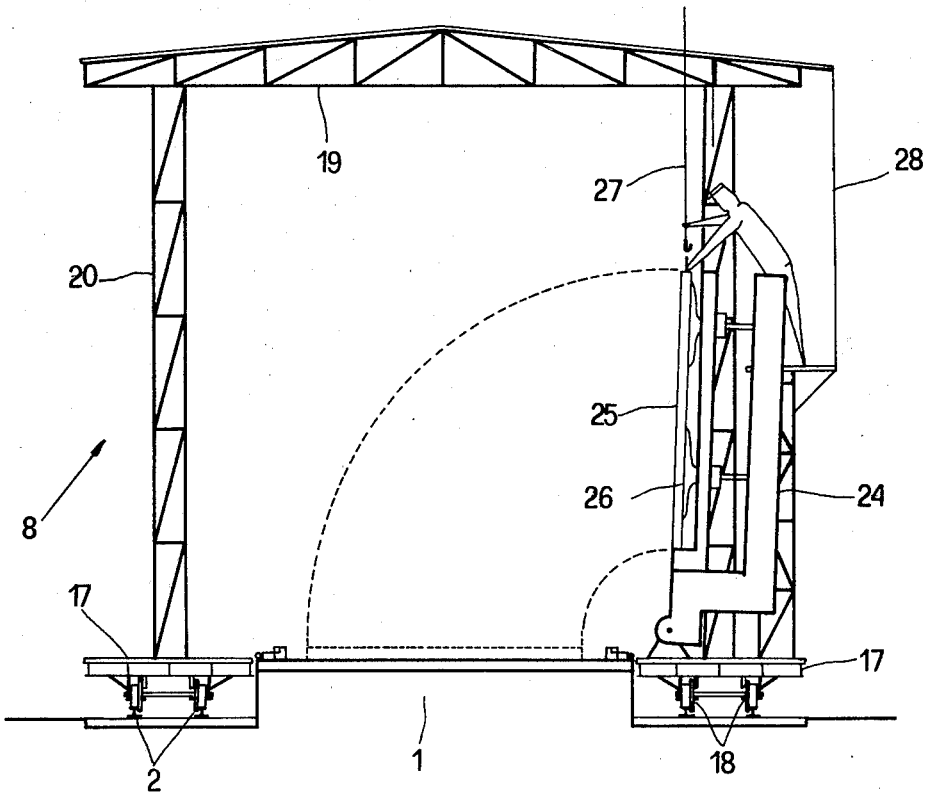
FIG. 4 is an elevational lateral view of a car equipped for tilting and removing concrete castings.

FIG. 4 shows the car 8 with its equipment for tilting up the hardened wall panels and for their removal after their release from the molds. This equipment 24 tilts the panel 25 into a vertical position, for instance by means of suckers 26 as shown in FIG. 4, or by hooks or even by tilting up the mold bottom if the latter is formed by single plates. The removal of the castings is by means of the bridge crane 5 shown in FIG. 1. Since this removal implies the lifting upwards of the panel 25, car 8 is not covered by a roof, save for the operator's cabin 28.

For lighter castings, such as floor beams, which need not be tilted up, car 8 will have no tilting machinery, since such beams can be directly lifted and fastened to the bridge crane.

Car 9, which follows directly car 8, is not shown in elevation. It is intended for the cleaning of the molds and for applying a mold release agent to the internal surfaces. Therefore the whole equipment may consist of rotating brushes and a compressed air installation for cleaning the molds and of tanks and sprayers for the mold release agent.

Figure 5:
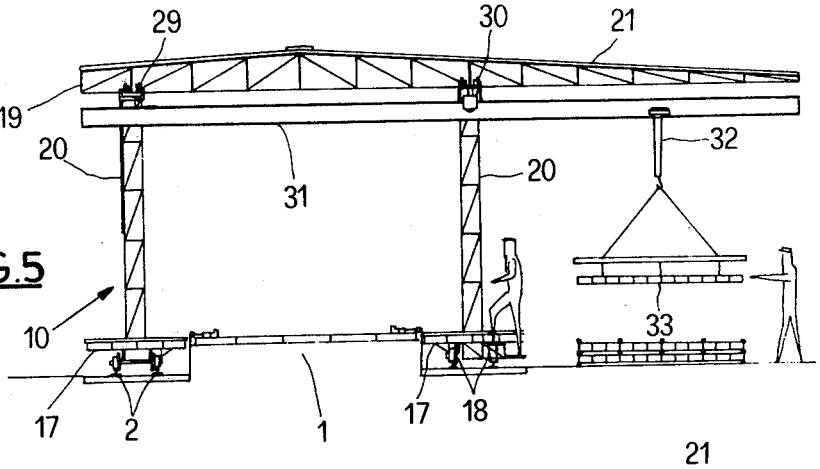
FIG. 5 is a lateral elevational view of a car equipped for placing into molds concrete reinforcing cages.

Car 10, illustrated in FIG. 5, serves for handling the reinforcement steel cages. One side of its trusses reaches over to cover the site of the steel cage piles. Two overhead rails 29 and 30 extend between the posts 20 of each trolley and are fastened to the underside of trusses 19. An I-beam 31 is slidably mounted across said rails, one end of this beam projecting as far as the extended side of the trusses. A winch 32 serves to lift the reinforcement steel cages 33 and place them into the molds.

Car 11 has already been described in connection with car 7. The successive car 12 is not shown in elevation by a particular figure. It serves to place the already mentioned inserts into the molds. This operation can be also effected manually by the personnel.

Figure 6:
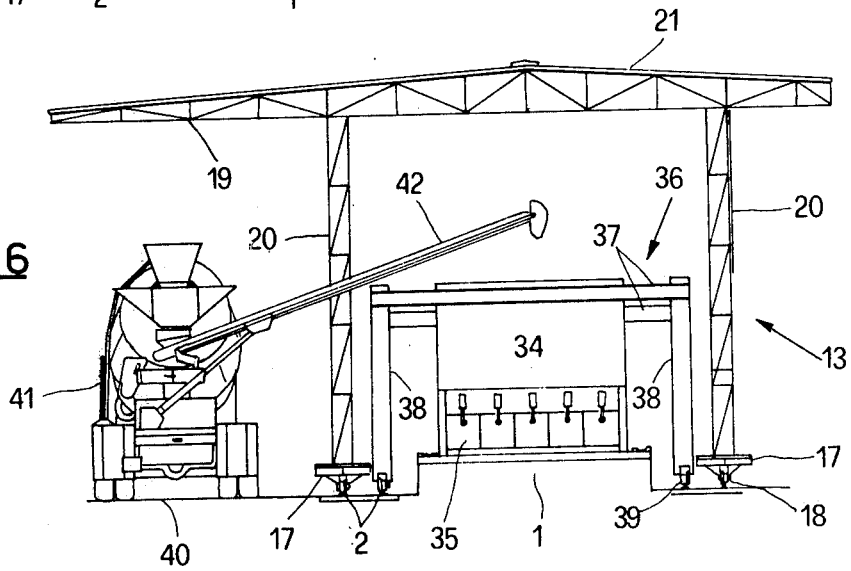
FIG. 6 is a lateral elevational view of a car equipped for casting concrete into molds.

Car 13 shown in FIG. 6 serves for pouring concrete into the molds. Its trolleys 17 ride on the outer ones of the pair of rails 2. It is fitted with a feed hopper 34, whose width equals at least the largest size the mold may assume and its bottom has a row of openings placed side by side and closed by bottom doors 35 which may be opened independently of each other so as to permit the adaptation of the width of the concrete stream to the width of the mold. The hopper 34 rests on a frame 36, which is vertically slidable along its four supports 38, so that its openings may always be kept level with the upper edges of the mold walls. The supports 38 rest on motor driven wheels 39 riding on the internal ones of the pair of rails 2. This arrangement gives the casting operation a certain flexibility relatively to the rhythm of the other operations, since the hopper 34 can move relatively to car 13 and independently of it. Alternatively the trolley platform can be fitted with rails, on which the wheels 39 can be placed instead of on rails 2.

On the side opposite to where the reinforcement steel cages are piled, a runway 40 can be provided, of a length at least equal to that of the rails 2, to permit the travel of the transport means carrying the supplies to the single cars of the train. FIG. 6 shows a concrete mixer 41 which feeds concrete into hopper 34 by means of a belt conveyor 42.

Cars 14 and 14' are not shown in elevation. They are fitted with any known equipment for finishing the surfaces of the castings, such as with vibrofinishers mounted on carriages supported by said cars and capable of a given independent movement with respect to the latter. The length of the connection of cars 14 and 14' with car 13 is rendered variable, such as by ropes and winches, to adapt the interval between the casting and the finishing operations to the time required by the casting to attain the necessary state of consolidation.

Figure 7:
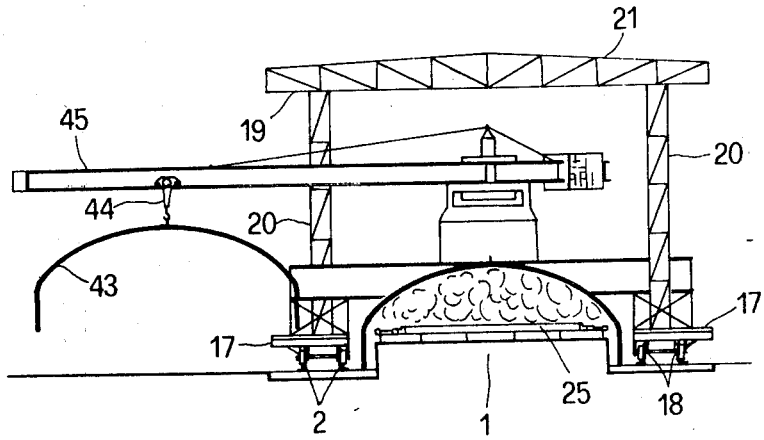
FIG. 7 is a lateral elevational view of a car placing hoods for the steam treatment of cast structural elements.

As already mentioned, a telescopically estensible roof connects the trusses of car 13 with those of cars 14 and 14', so that the castings remain sheltered whatever is the distance between these cars. The last car 16, shown in elevation in FIG. 7, serves for the steam treatment of the castings in order to accelerate the curing or maturation of the concrete. Its equipment comprises a hoist 44 running on a horizontally rotatable I-beam 45. This permits to seize the hoods 43 which are placed laterally to the track and place them upon the castings, whereafter steam is blown in between them.

Alternatively, car 16 may also be equipped with a machine for unrolling and uprolling a mat or canvas which is automatically spread upon the fresh casting on track 1 during the passage of train 3 along them, to permit thereby their steam curing. At the end of the operating cycle and the completion of the steam curing, the whole train will revert to its starting point and said machine will roll the canvas up.

The advantages offered by the plant of the invention have already been summarized. It is clear that its production capacity may be easily adapted to requirements by varying the length of the track 1 and of the rails 2 and 6, and by varying the number of the cars. Similarly the types of structural elements produced can be varied by simply replacing the above described cars partially or completely with cars mounting a different machinery and by changing the mold walls on track 1. Similarly, pre-stressed concrete elements can be easily produced since the ends of track 1 are free for applying to them steel tensioning devices.

The train of cars can be driven in any suitable manner, either by powering with a motor any single car, or interconnecting one part or all of the cars and driving them by a system of cables and winches. These and other variants in the number of the cars, in the machinery applied to them, in the lay-out of the track, the conformation of the mold, ect. are all encompassed in the scope of the invention.

What is claimed is:

1. A plant for the production of prefabricated concrete structural units comprising: a longitudinally extending track having a horizontal upper surface; a plurality of transverse walls spaced apart longitudinally along the track and a plurality of transversely spaced apart longitudinal walls, said transverse and longitudinal walls being connected to the track in a manner to form with the upper surface of the track a plurality of stationary molds arranged along the track; a train of cars movable stepwise along the plurality of molds; equipment mounted on each car to perform on the molds at least one operation of a casting cycle; and roofing on the cars extending over the molds to protect the casting cycle operations from the weather.

2. A plant as in claim 1 wherein each car straddles the track, each car including two trolleys, one at each side of said track, said trolleys being rigidly interconnected by structure disposed above the level of the molds.

3. A plant as in claim 2 wherein said rigid interconnection includes trusses fastened to the top ends of posts, the bottom ends of said posts being fastened to the trolleys, said trolleys riding on rails running along each side of said track.

4. A plant as in claim 1 wherein said upper surface of said track is a single metal plate extending from one end to the other of said track, said plate forming a common bottom plate for the molds arranged on said track.

5. A plant as in claim 1 wherein said upper surface of said track is a succession of metal plates, each plate forming the bottom plate of at least one mold arranged on said track.

6. A plant as in claim 3 wherein said rails extend beyond each end of said track of a distance at least equalling the length of said train of cars.

7. A plant as in claim 1 wherein said train comprises a car equipped with tools for displacing the mold walls to obtain a mold of desired dimensions, a car equipped with machinery for cleaning said molds and applying mold release liquids to their internal surfaces, a car equipped with machinery for applying inserts into said molds, a car equipped with machinery for pouring concrete into said molds, at least one car equipped with machinery for vibrofinishing the concrete cast into said molds, and a car equipped with machinery for steam-curing the concrete cast in said molds.

8. A plant as in claim 7 wherein the car for pouring said concrete and at least one car for vibrofinishing said concrete are covered by a telescopic roof extending between them.

9. A plant as in claim 7 wherein the equipment mounted on the car for adjusting the distance between mold walls and on the car for pouring the concrete is positioned on means which render it capable of moving independently from the movement of the said cars.

10. A plant for the production of prefabricated concrete structural units comprising: a plurality of stationary molds arranged in a horizontally extending longitudinal row, said molds being formed by a stationary longitudinal track having an upper surface and a plurality of longitudinally spaced apart transverse mold walls and a plurality of transversely spaced apart longitudinal mold walls, said mold walls cooperating with the upper surface of the track so that said upper surface forms the bottom of each mold; a plurality of longitudinally movable cars arranged along the track, each car straddling the track and including two platforms disposed on opposite sides of the track, said platforms providing space for workmen and being approximately level with the upper surface of the track and disposed close to the track so that only a small gap exists between the track and the platforms, each car further including ground-engaging wheels disposed below the platforms and rigid connecting means extending transversely across the track at a distance above the track, and roofing supported by the connecting means and overlying the platforms and the adjacent mold.

* * * * *